US005404627A

United States Patent [19]

Shepherd

[11] Patent Number: 5,404,627

[45] Date of Patent: Apr. 11, 1995

[54] CASKET SYSTEM

[76] Inventor: Beverly J. Shepherd, 3501 Geraldine La., Richmond, Ind. 47374

[21] Appl. No.: 124,765

[22] Filed: Sep. 21, 1993

[51] Int. Cl.[6] ..... A61G 17/00

[52] U.S. Cl. ..... 27/2; 27/9

[58] Field of Search ..... 27/2, 9, 14, 35; 5/419, 5/132

[56] References Cited

U.S. PATENT DOCUMENTS 772,747 10/1904 Ripson ..... 27/5

2,046,905 7/1936 Nold ..... 27/2 X

*Primary Examiner*—Carl D. Friedman

*Assistant Examiner*—Creighton Smith

*Attorney, Agent, or Firm*—R. William Graham

[57] ABSTRACT

The present invention is directed to a casket system having a bottom wall, a pair of side walls, a pair of end walls, a lid, and bed-like members of like material and construction, the side walls, the end walls and the bottom wall connected to form an open box, the lid removably securable to ledges of the box adjacent the opening of the box to provide a coffin, and wherein the box ledges include means for removably securing the bed-like members thereto when the lid is removed to provide a bed-like arrangement.

18 Claims, 2 Drawing Sheets

CASKET SYSTEM

BACKGROUND OF THE INVENTION

The present invention relates generally to caskets, and more particularly, but not by way of limitation, to a casket system which is convertible to provide a bed-like arrangement.

Caskets are a necessary part of the funeral director's business and must meet with certain legal requirements. By and large, caskets have been made and sold by manufacturers to suit their purposes.

Over the past century, people have tried to diminish the visual effect of caskets. Caskets are a symbol of death and no one really likes to look at caskets.

None of us can actually imagine our own demise and being placed in a box with a lid about to be closed over us forever. For this reason, the lid may be the most offensive aspect of the casket appearance. Thus, there remains a need to soften the visual effect of the casket.

Previously, others have attempted this by creating devices to draw attention to the deceased. Improvements in the field of casket-making have centered on providing a casket which presents the corpse in the most restful or peaceful position during the viewing by mourners. For example, devices have been made which fit within a casket to raise or angle parts of the body into particular positions such as the tilting of the upper torso so that the body faces slightly toward the viewing side of the casket.

The present invention, however, is an attempt to mask the environment within which the deceased is laid to rest by providing a casket system which has high aesthetic qualities which departs from the typical mournful funeral effect incident to burial caskets as heretofore made.

SUMMARY OF TEE INVENTION

It is an object of the present invention to provide a casket system which departs from a typical gloomy funeral effect with a coffin incident to burial by providing the casket arranged in a manner to imitate a bed upon which the body is made to appear sleeping restfully.

It is a further object of the present invention to provide a novel casket system which induces a family gathering around the loved one.

It is a further object of the present invention to provide for a casket system which can be quickly and easily assembled and disassembled after the viewing service.

These and other objects will become apparent upon the reading of the following description, drawings and claims.

To accomplish these objects, the present invention provides a novel casket such that the casket is arranged in an imitation of a bed having bed posts adjacent the juncture of the end walls and the side walls of the casket, or optionally a head and foot board attached respectively thereto, and being arranged in the attitude of sleep with decor or printed memorabilia attached to the bedding of the casket significant to the deceased and/or his family.

Accordingly, the present invention is directed to a casket system which includes a bottom wall, a pair of side walls, a pair of end walls, a lid, and bed-like members of like material and construction, the side walls, the end walls and the bottom wall connected to form an open box, the lid removably securable to ledges of the box adjacent the opening of the box to provide a coffin, and wherein the box ledges include means for removably securing the bed-like members thereto when the lid is removed to provide a bed-like arrangement. Additionally, the casket system includes a bier to support the coffin and further enhance the bed-like arrangement. Preferably the bier and bed-like members are configured in a complimentary configuration.

In a preferred embodiment, bed-like members are bed posts and the means for removably securing the bed-like members include threaded members, wherein the bed-like members and the box ledges have threaded open surfaces defined therein complimentary to and adapted to threadably receive the threaded members. In an alternative embodiment, the bed-like members include a head board and a foot board and the means for removably securing the bed-like members include pin members, wherein the bed-like members and the box ledges have orifice surfaces defined complimentary to and adapted to receive the pin members. The casket system further includes a comforter configured to connect over the box ledges and about the bed-like members when the casket system is in the bed-like arrangement to further enhance the bed-like arrangement. Alternatively, the system includes a bedding with memorabilia attached thereto and which is connectable to the inside of the casket.

DETAILED DESCRIPTION OF THE PREFERRED EMBODIMENT

Figure 1:
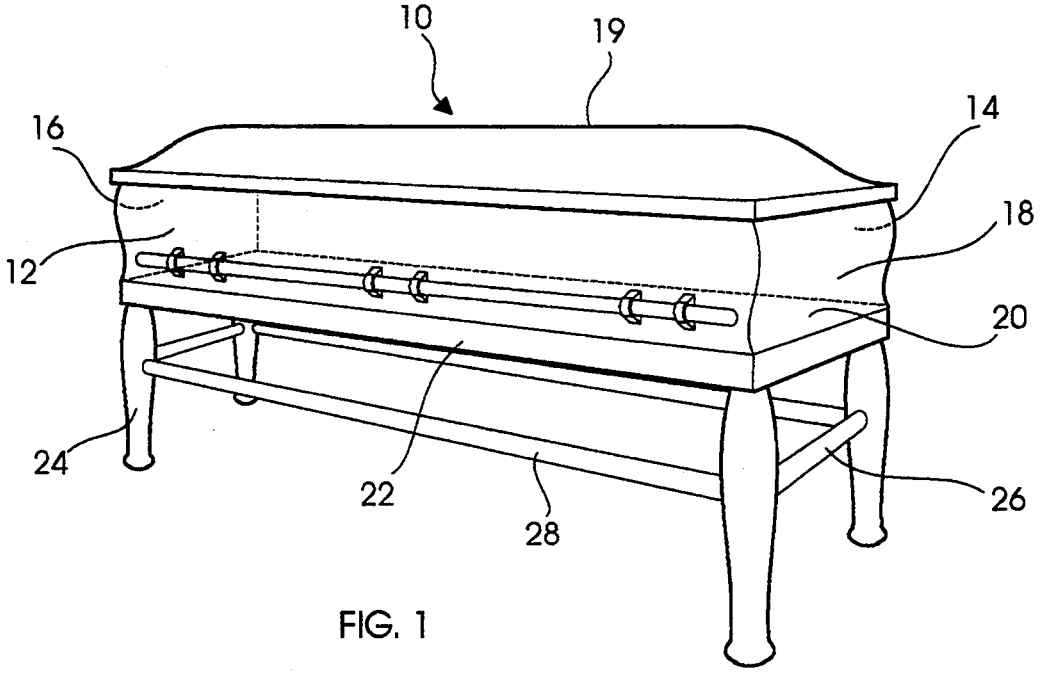
FIG. 1 is a side view of the casket of the present invention in closed relation.

Referring to the drawings, in which like parts are indicated by like numerals, the casket system is generally indicated by the numeral 10. The casket system 10 can be made of materials such as metal, wood, fiberglass or polymeric material and include pigmentations or stains as are known in the art. The casket system 10 includes an open box having side walls 12 and 14, end walls 16 and 18, a lid 19 and a bottom wall 20 formed by molding or techniques known in the art.

The casket system 10 is elevated by a bier which includes a support surface 22 of a size and configuration substantially that of the bottom wall 20. Also, legs 24 extend downwardly from the support surface 22 to a floor 25, and brace members 26 and 28 interconnect legs 24. The bier is configured and arranged to lend the appearance of a bed frame.

Figure 2:
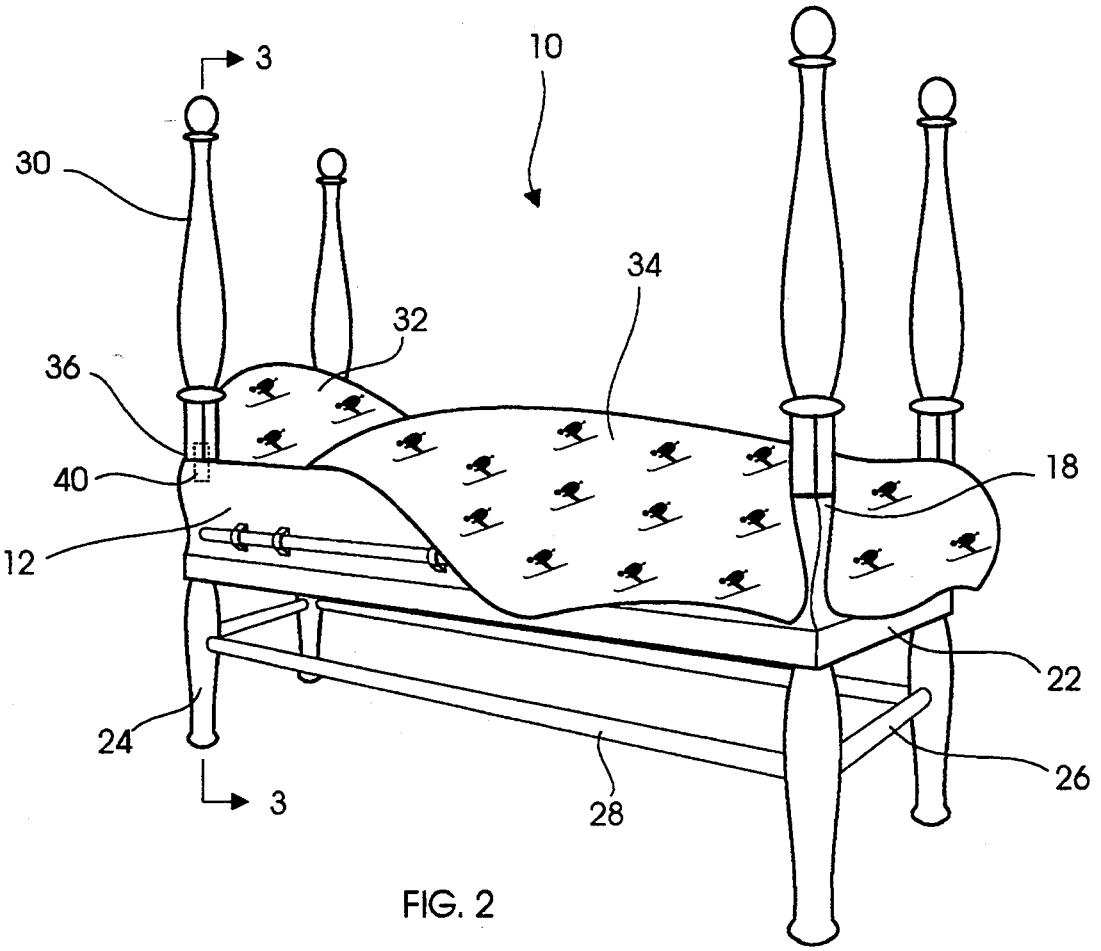
FIG. 2 is a perspective view of the present invention in an open relation, arranged in the form of the bed, the lid being removed.
Figure 4:
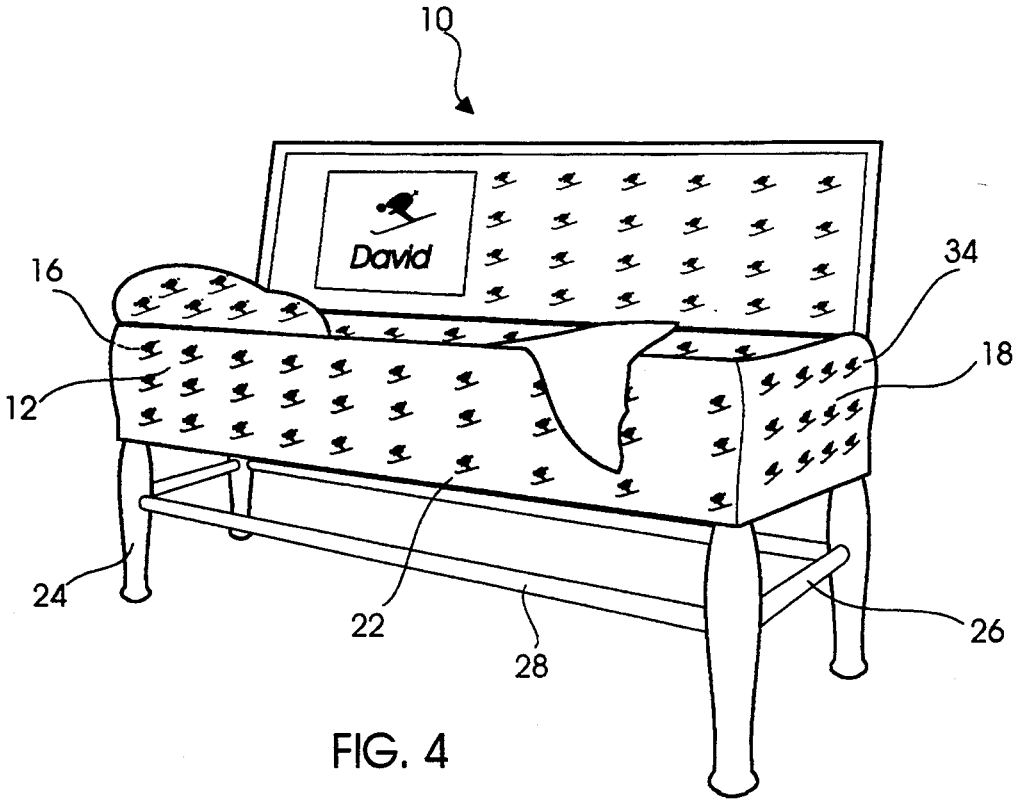
FIG. 4 is a side view of another embodiment of the present invention.

Bed posts 30 are removably securable to the ledges 32 adjacent the juncture of the side walls 12 and 14 and end walls 16 and 18 when the lid 19 is removed. In the embodiment shown in FIG. 2, a comforter or bedding material 34 is provided of a length and width to substantially drape over the side walls 12 and 14 and the end wall 18. As seen in FIG. 4, the bedding material 34 can be printed with memorabilia, of a particular sport or activity, for example, which is significant to the loved ones or deceased. Thus, the bed-like appearance is further enhanced. Casket system 10 includes a mattress and pillow upon which the deceased can rest, which can likewise be printed with memorabilia. The mattress is of a type which can be uniformly elevated to further enhance the bed-like appearance.

Figure 3:
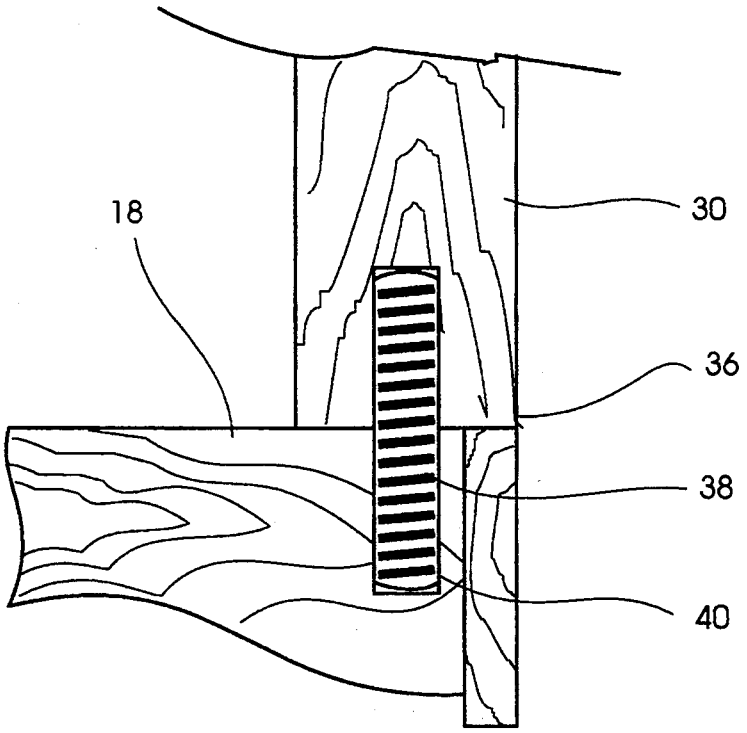
FIG. 3 is a partial vertical cross-section taken along line 3—3 of FIG. 2.

As best seen in FIG. 3, bed posts 30 are shown as having included in attaching end 36, a screw 38. The screw 38 resides partially in the end 36 with the other end protruding axially outward from the post 30 and into a threaded bored surface 40 beginning in the ledge 32 of the end wall 18, for example. This allows the bed post 30 to be readily assembled to the end walls 16 and 18 for viewing and disassembling for burial. Alternatively, generally cylindrical pins could be used instead of screws which would fit into generally cylindrical surfaces of the ledges 32. It is also conceived rather than bed posts 30, a head and foot board could be provided, and other variations which would provide the bed-like effect. While the present invention discloses a particular means for fastening the bed posts and head and foot boards, it is realized that other devices exist in the art, such as a detent mechanism.

When closing the casket system 10, the bedding 34 can be folded and placed along side the deceased. The bed posts 30 can be readily unscrewed and set aside and bier removed for re-use. The lid 19 can then be placed over the opening formed by the side walls 12 and 14 and end walls 16 and 18 as shown in FIG. 1. The lid 19 can then be readily fastened to the walls 12, 14, 16 and 18 by techniques known in the art in order to lock the lid 19 thereto.

Also, it is contemplated that in an alternative embodiment, a head board and a foot board could be attached by side rail members constructed in a manner to support the box of the casket system. For example, the side rails can be of an L-shaped configuration and of a size to cover the side walls of the box, wherein the L-shaped side rails have a longitudinally extending lip to lengthwise support the box. In this embodiment, the box may be removed and the head and foot boards and side rails remain in tact to be used with another box.

Many other modifications, derivations and improvements will become readily apparent to those skilled in the art and the present invention should therefor be entitled to the scope and benefit of such claims.

What is claimed is:

1. An improved casket system, comprising:

an open box having a bottom wall, a pair of side walls, a pair of end walls, and bed-like members having an aesthetic aspect which masks the environment within which the decedent is laid to rest, wherein said walls and members are of like material and construction, said side walls, said end walls and said bottom wall connected to form said open box, said walls forming ledges adjacent an opening of said box;

a lid removably securable to at least one of said ledges of said box adjacent the opening of said box to provide a coffin; and means for removably securing said bed-like members to said ledges when said lid is removed to provide a bed-like arrangement.

2. The casket system of claim 1, wherein said bed-like members are bed posts.

3. The casket system of claim 1, wherein said means for removably securing said bed-like members include threaded members and wherein said bed-like members and said box ledges have threaded open surfaces defined therein complimentary to and adapted to threadably receive said threaded members therein.

4. The casket system of claim 1, wherein said bed-like members include a head board and a foot board.

5. The casket system of claim 1, wherein said means for removably securing said bed-like members include pin members, wherein said bed-like members and said box ledges have orifice surfaces defined therein complimentary to and adapted to receive said pin members therein.

6. The casket system of claim 1, which further includes a bedding configured to connect over said box ledges and about said bed-like members when said casket system is in said bed-like arrangement and drape over said side walls and one of said end walls to further enhance said bed-like arrangement.

7. The casket system of claim 1, which further includes a bier frame having a support surface, a plurality of legs extending upwardly from a floor surface and connecting to said support surface, and brace members connecting into said leg members.

8. The casket system of claim 1, which further includes a bier which supports said box and having an appearance and configuration complimentary with said bed-like members.

9. The casket system of claim 1, which further includes a bedding having printed memorabilia thereon and configured to connect to and drape over said side walls and one of said end walls to further enhance said bed-like arrangement.

10. The casket system of claim 1, which further includes bedding attached to the inside surfaces of said box and draped outwardly about said bed-like members to further enhance the bed-like arrangement and create an appearance of a bed complete with quilt and linens.

11. An improved casket system, comprising:

an open box having a bottom wall, a pair of side walls, a pair of end walls, and bed-like members having an aesthetic aspect which masks the environment within which the decedent is laid to rest, wherein said walls and members are of like material and construction, said side walls, said end walls and said bottom wall connected to form said open box, said walls forming ledges adjacent an opening of said box;

a lid removably securable to at least one of said ledges of said box adjacent the opening of said box to provide a coffin; and means for removably securing said bed-like members to said ledges when said lid is removed, and further including a bedding configured to connect over said box ledges and about said bed-like members when said casket system is in a bed-like arrangement and drape over said side walls and one of said end walls to mask said coffin and provide said bed-like arrangement.

12. The casket of claim 11, wherein said bed-like members are bed posts.

13. The casket system of claim 11, which further includes a bier frame having a support surface, a plurality of legs extending upwardly from a floor surface and connecting to said support surface, and brace members connecting into said leg members.

14. The casket system of claim 11, which further includes a bier which supports said box and having an appearance and configuration complimentary with said bed-like members.

15. An improved casket, comprising:

an open box having a bottom wall, a pair of side walls, a pair of end walls, said side walls, said end walls and said bottom wall connected to form said open box, said walls forming ledges adjacent an open end of said box;

a lid removably securable to at least one of said ledges of said box adjacent the opening of said box to provide a coffin; and a bedding having printed memorabilia thereon configured to connect to and drape over said side walls and one of said end walls to mask said coffin and provide a bed-like arrangement.

16. The casket of claim 15, which further includes other bedding material having memorabilia printed thereon connected to and spanning an inner surface of said lid, wherein said lid is connectably displayable adjacent said coffin in a cooperating fashion to enhance said memorabilia of said bedding.

17. The casket system of claim 16, which further includes a bier frame having a support surface, a plurality of legs extending upwardly from a floor surface and connecting to said support surface, and brace members connecting into said leg members.

18. The casket system of claim 16, which further includes a bier which supports said box and having an appearance and configuration complimentary with said bed-like arrangement.

* * * * *